United States Patent [19]

Rabinovich et al.

[11] 4,192,370

[45] Mar. 11, 1980

[54] DEVICE FOR EFFECTING ELECTROSLAG REMELTING PROCESSES

[75] Inventors: Volf I. Rabinovich; Jury N. Kriger, both of Chekhov; Igor A. Svitenko, Moscow; Viktor E. Sapunov, Chekhov, all of U.S.S.R.

[73] Assignee: Chekhovsky Zavod Energeticheskogo Mashinostroenia, U.S.S.R.

[21] Appl. No.: 816,695

[22] Filed: Jul. 18, 1977

Related U.S. Application Data

[62] Division of Ser. No. 638,942, Dec. 8, 1975, abandoned.

[51] Int. Cl.[2] ..... B22D 27/02

[52] U.S. Cl. ..... 164/252; 164/123

[58] Field of Search ..... 164/50, 52, 250, 252, 164/123; 75/10, 1, 12; 13/9, 9 ES; 249/106, 197, DIG. 5

[56] References Cited

U.S. PATENT DOCUMENTS

| | | | |
|---|---|---|---|
| 3,586,749 | 6/1971 | Iodkovsky | 164/52 X |
| 3,920,063 | 11/1975 | Sasaki et al. | 164/123 |
| 3,947,265 | 3/1976 | Guzowski et al. | 75/10 R |

FOREIGN PATENT DOCUMENTS

| | | | |
|---|---|---|---|
| 864420 | of 1941 | France | 249/204 |
| 1204753 | of 1960 | France | 249/206 |

*Primary Examiner*—Robert D. Baldwin
*Assistant Examiner*—K. Y. Lin
*Attorney, Agent, or Firm*—Lackenbach, Lilling & Siegel

[57] ABSTRACT

The present invention relates to a method of and a device for effecting electroslag remelting processes.

While effecting an electroslag remelting process by the proposed method an electrode is dipped into a slag bath. Electric current is passed through the electrode and slag bath, heating the slag to a melting point of said electrode. Upon establishing the molten slag bath and a metal pool said electrode is shielded by lowering on the surface of the molten slag bath a disc with an opening for the passage of said electrode so that the disc will float in the slag without coming in contact with the metal pool. A device for effecting electroslag remelting processes, comprising a baseplate mounting a means for effecting an electro slag remelting process accommodating a slag bath and an electrode that is dipped thereinto and is encompassed with a protective shield made as a disc of material whose specific density is lower than that of the slag of said slag bath. The disc is arranged directly on the surface of the slag bath, overlapping essentially all its surface area.

3 Claims, 13 Drawing Figures

DEVICE FOR EFFECTING ELECTROSLAG REMELTING PROCESSES

This is a division of application Ser. No. 638,942, filed Dec. 8, 1975 now abandoned.

The present invention relates to a method of and a device for effecting electroslag remelting processes and more particularly to a method of and device for realizing an electroslag remelting of consumable metal electrodes, for casting metal ingots by the electroslag remelting technique and electroslag welding of metals and their alloys, such as, various steel grades, brasses, etc.

At present known in the art is a large number of methods for carrying into effect electroslag remelting processes. According to one of such methods for effecting the electroslag remelting of metal in a cooled mold, ingots in remelted metal are produced from metal consumable electrodes melted in a slag bath under the effect of heat given up in molten slag by the passage of electric current therethrough. Usually a known electroslag remelting plant comprises a baseplate mounting a cooled mold in which a slag bath is established and a consumable electrode is arranged movably with respect to the mold, the bottom end of said electrode being dipped into the slag bath. Under the effect of electric current flowing from a current source through the electrode, slag bath and the baseplate the electrode immersed into the slag bath fuses and remelts into an ingot.

The main disadvantages of this method and plant consist in low electrical energy efficiency and in the oxidation of easily-oxidizable elements contained in the metal.

In casting ingots by using the known method of electroslag remelting molten metal is poured into a mold filled with molten slag. According to the above method, at first solid slag is charged into the mold. After that electric current is passed through an electrode, slag bath and baseplate, said current heating and melting the slag, whereupon molten metal in a fluid state is poured into the mold where it is heated during solidification due to the passage of electric current through the electrode, molten slag and molten metal.

The above method of casting ingots by electroslag remelting is realized in a plant, comprising a mold which accommodates an electrode mounted movably with respect to the mold and adapted for melting slag contained in the mold and for subsequent heating of metal being cast.

One of the main disadvantages of said method and plant resides in high specific energy consumption.

Known also is a method of electroslag welding in which in a space bounded by the edges of articles being welded and molding devices a molten slag bath is set up into which a metal electrode is dipped and through which electric current is passed. Flowing through the electrode, slag bath and base metal the current heats molten metal and the slag bath and maintains their high temperature and electrical conductivity. The heated molten slag melts the electrode introduced thereinto and the edges of article elements being welded. The metal obtained when the edges of the article elements being welded are being melted, as well as molten metal formed by the melting electrode flow to the bottom of the slag bath establishing a metal pool which, on being solidified, molds the weld interconnecting the edges of the articles being welded.

The disadvantages of the known method of electroslag welding include low energy efficiency, oxidation of easily-oxidizable elements contained in metal and the impossibility of adjusting edges and fusion of parts being welded.

Thus, all the above-specified methods and plants suffer from a common disadvantage - low energy efficiency due to heavy heat losses.

As shown by the analysis of heat losses, most of the heat is lost in the contact zone of a slag bath and the surface of molding devices.

In one of the present-art methods of effecting an electroslag remelting process heat losses are decreased by providing an electrode being melted with a protective shield. With the above method the consumable electrode is dipped into a slag bath, as it is being fused under the effect of electric current flowing through the electrode and slag, said slag bath accommodating also a protective shield made as a cylindrical ring encompassing the electrode part immersed in the slag bath.

The lower end of such a shield is constantly sustained on the level of the lower end of the consumable electrode.

A plant for effecting said method comprises a protective shield made as a cylindrical ring encompassing a consumable electrode. The protective shield is cantilevered on a vertical transfer gear, the bottom end of this protective shield being always maintained on the level of the lower end of the consumable electrode with the aid of said gear and a device for monitoring the required depth of immersion of the protective shield in the slag bath.

The known method of effecting an electroslag remelting process, in which the protective shield is carried by means of the vertical transfer gear calls for sophisticated equipment, such as, a shield transfer gear and a device for monitoring the requisite depth of immersion of the shield in the slag bath.

This known method fails to control current distribution in a slag bath, to decrease thermal radiation losses of the slag bath and to obviate the oxidation of easily-oxidizable elements contained in metal.

The main object of the present invention is to provide a method of effecting electroslag remelting processes in which all the heat liberated due to the passage of electric current through an electrode and a slag bath would be essentially employed for melting the electrode and heating the molten slag bath.

These and other objects of the present invention are achieved by the fact that in a method for effecting an electroslag remelting process, comprising the steps of shielding an electrode, dipping it into a slag bath, passing electric current through the electrode and slag bath, said current heating the slag to at least a metal melting point, according to the invention, shielding is effected upon producing molten slag and establishing a metal pool by lowering on the surface of the slag bath of a disc with an opening for the passage of the electrode so that the disc will float in the slag without coming in contact with the metal pool, the disc floating in the slag bath since it is manufactured from material with a specific density lower than that of the slag.

By carrying out the electroslag remelting process in the above manner it is possible to diminish heat losses in the zone of contact of a slag bath with the surface of a molding device, e.g., a mold. It enables also a nearly complete reduction in thermal radiation losses of the slag bath and redistribution of current densities in the melting zone of the consumable electrode. All these factors provide for a higher electrical energy efficiency.

It is expedient that with the above method of effecting an electroslag remelting process a disc of a material superior in electrical conductivity to molten slag is lowered on the surface of a slag bath.

In this way it is possible to provide current concentration around the melting electrode by compressing an electric field.

While using the above method it is good practice if a disc lowered on the surface of a slag bath is produced from material superior in its deoxidizing ability to elements contained in the metal and slag.

This would make it possible to preserve such easily-oxidizable elements as Al, Ti, Si and others in the metal being remelted. In this case a better effect is attained if the disc, descended on the bath surface is manufactured from material forming during deoxidation reactions which generate gaseous products that are removed together with evolving gases.

It is expedient that the disc lowered on the surface of the slag bath be preheated, its heating temperature being selected within a range from about 500° C. to about 1200° C. depending on technological requirements.

Usually the disc produced is from graphite, graphitic carbon or carbonaceous material.

Therefore for producing protective atmosphere which would protect the molten slag and melting electrode against oxidation the disc must be preheated to a temperature of at least +500° C.

This stems from the fact that carbon contained in the disc combines with oxygen from ambient air, forming the protective atmosphere, at a minimum temperature of +500° C.

We have found that +1200° C. must be considered the most favorable preheating temperature, since it can be attained by using conventional heating sources, and since the introduction of a disc, heated to such a temperature, into a slag bath does not disturb the stability of electroslag remelting, an average disc temperature during the electroslag remelting process approximating +1200° C.

Thus, the preheated disc does not disturb the stability of the process at the moment it is being fed into the slag bath, and it provides the creation of a protective atmosphere at such moment.

As the disc is consumed, similar discs are generally lowered thereon from above.

This technique must be resorted to when effecting a continuous electroslag remelting process, when a disc lowered initially on the surface of a slag bath is consumed before the conpletion of the refining process.

In accordance with these and other objects, the essence of the present invention consists also in that in a device for effecting an electroslag remelting process, comprising a baseplate mounting a means for carrying out an electroslag remelting process, accommodating a molten slag bath with an electrode that is provided with a protective shield and connected to a current source, according to the invention, the protective shield is made as a disc of a material whose specific density is lower than that of the slag, said disc overlapping essentially the entire surface area of the slag bath, and being fitted with an opening for the passage of the electrode and arranged in the means for effecting an electroslag remelting process with a clearance between the internal surface of this means and a disc side wall, amounting to at least the thickness of a scull crust on the means interior, its clearance between the wall of the disc opening and the electrode being equal to at least the thickness of a scull crust on the electrode.

Since the protective shield is made as a disc in material whose specific density is lower than that of the slag, it will float on the slag surface functioning as a protective shield overlapping essentially the entire surface area of the slag bath.

Due to the opening provided in the disc for the electrode passage and forming the clearance with the electrode, as well as due to the clearance between the internal surface of the means for effecting an electroslag remelting process and the disc side wall, the disc can freely move upwards as the metal is being built up. To prevent the disc from being stuck as it moves upwards the above clearances must be equal to at least the thickness of a scull crust formed on the internal surface of the means for effecting an electroslag remelting process and on the electrode.

The protective shield can be made as a disc of increased or increasing thickness towards its periphery.

Such discs are advisable to be used when it is necessary to redistribute thermal power of the slag bath from its centre to the periphery.

It is also expedient that the protective shield be made as a disc of increased or increasing thickness towards its center.

In this case the heat of the slag bath will be concentrated in its central portion.

It is sound practice that the disc be provided with through conduits running inside it from the center to the periphery.

This would provide an intense stirring of the slag and better deoxidation during the elestroslag remelting process.

The nature of the invention will be clear from the following detailed description of its particular embodiments to be had in conjunction with the accompanying drawings, in which.

Figure 9:
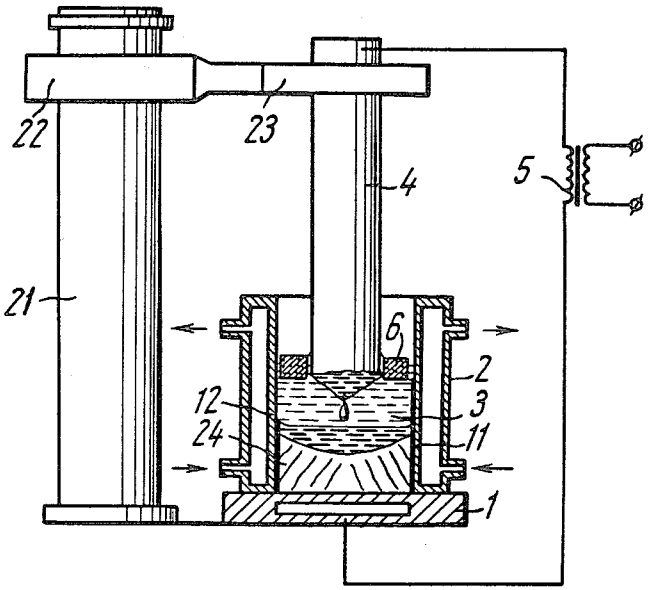
Figure 11:
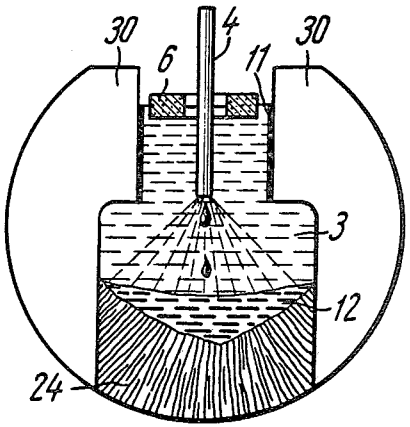
Figure 10:
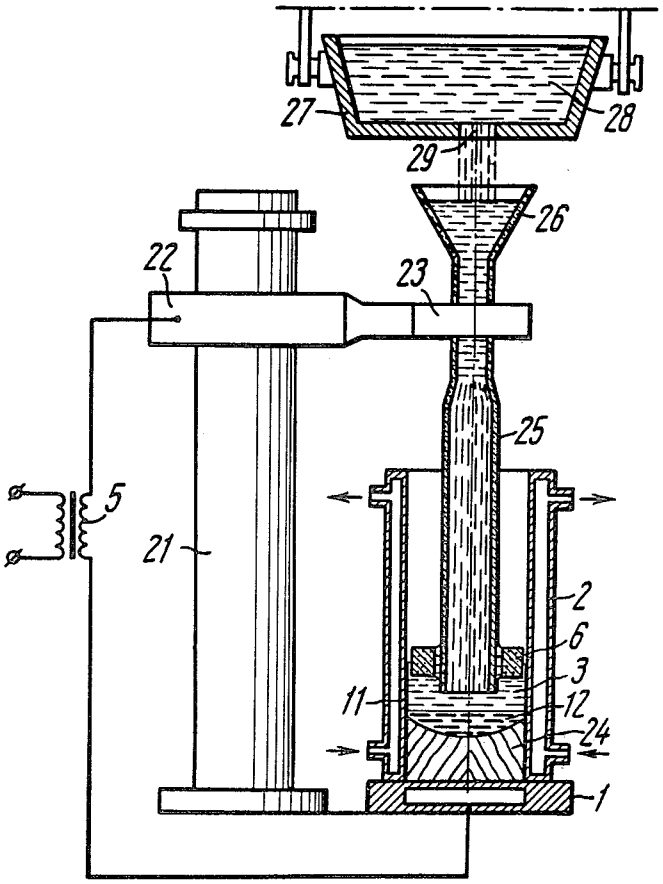
Figure 13:
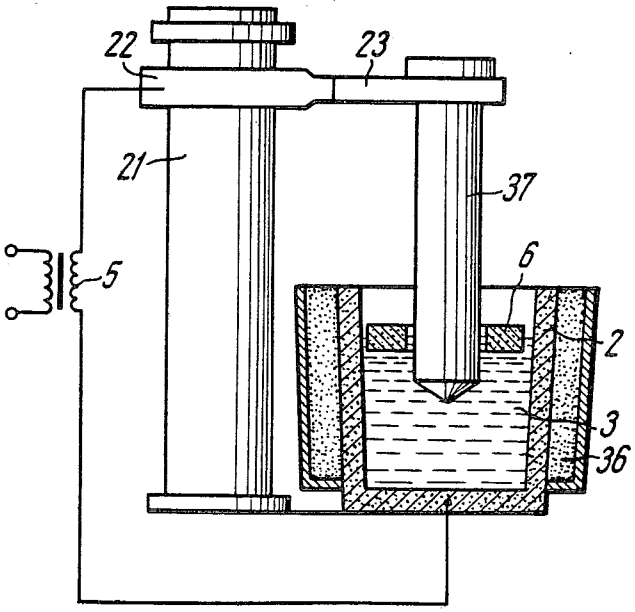
Figure 12:
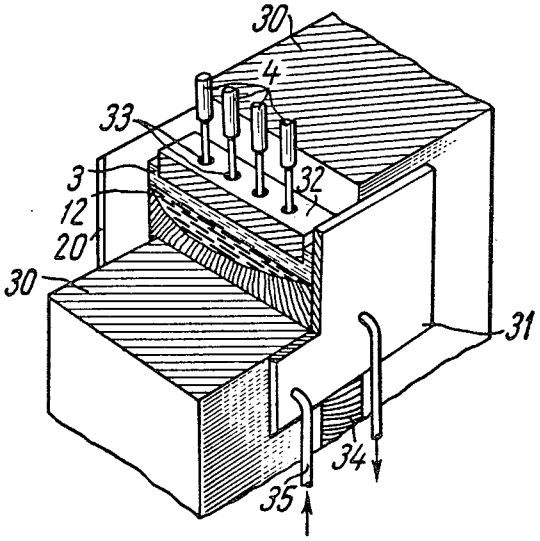

FIG. 9 further illustrates an overall apparatus for electroslag remelting of consumable metal electrodes;

FIG. 10 shows a further device for the casting of metal ingots by the electroslag remelting technique;

FIG. 11 shows the relative position of an electrode, slag bath and a disc, according to the invention, and of the edges of parts being welded when electroslag welding is carried out with a single electrode;

FIG. 12 shows the relative position of electrodes, a slag bath and a disc, according to the invention, and slag-retaining devices when welding the edges of parts of large thickness by the electroslag welding technique with a plurality of electrodes; and FIG. 13 depicts a slag-melting device.

Figure 1:
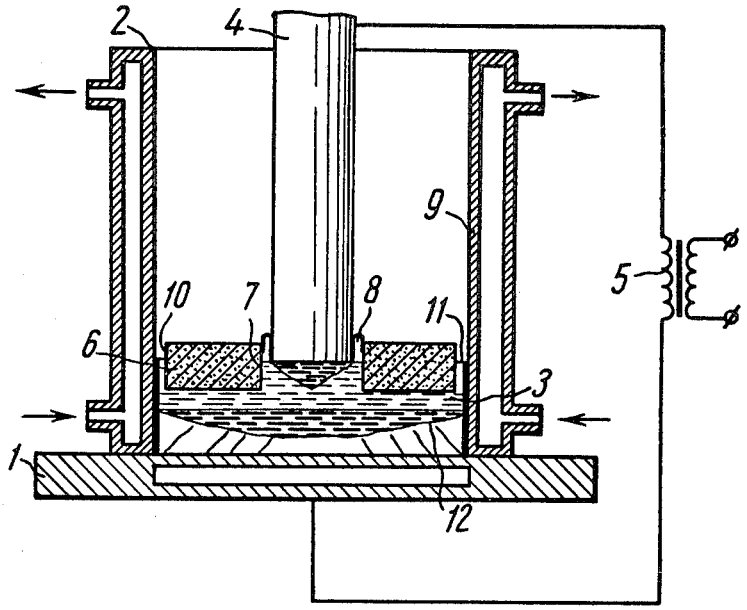
FIG. 1 shows a cross-sectional view of a device for effecting an electroslag remelting process.

The essence of the present invention will become more fully apparent by referring now to FIG. 1 which is a general view of a device for effecting electroslag remelting processes.

Described hereinafter will be specific devices for effecting electroslag remelting of consumable metal electrodes, a device for casting metal ingots by electroslag remelting and a slag-melting-and-heating device.

The electroslag remelting process is carried out in a means for effecting such a process, said means having a specific embodiment for each of the above-specified processes. Thus, for electroslag remelting of metals and for casting metal ingots by the electroslag remelting technique it will be a cooled mold, for electroslag welding said means is formed by the edges of parts being welded and slag-retaining devices, while for melting and heating slag a crucible in a refractory material is used.

A baseplate 1 (FIG. 1) mounts a means 2 for effecting an electroslag remelting process. Usually a cooled metallic plate is employed as the baseplate 1.

The means 2 for effecting an electroslag remelting process accommodates a molten slag bath 3 into which is dipped an electrode 4 connected to one of the poles of a current source 5. Depending on the characteristic features of the electroslag remelting process, either a consumable or non-consumable electrode 4 may be used.

The molten slag bath 3 can be set up either by molten slag starting, i.e. by pouring preliminary fused slag, or by melting dry slag in the means 2 due to the passage of electric current through the electrode 4, slag 3 and baseplate 1 connected to the other pole of the current source 5.

Arranged in the means 2 for effecting an electroslag remelting process on the surface of the slag bath 3 is a protective shield, such as a protective means made in the form of a material with a specific density lower than that of the slag (such as, graphite, carbon, graphitic carbon or other suitable carbonaceous material) and overlapping essentially the entire surface area of the slag bath 3.

The disc 6 has an opening for the passage of the electrode 4 so that a clearance between the wall 7 of the opening in the disc 6 and electrode 4 will amount to at least the thickness of a scull crust 8 on the electrode 4.

The disc 6 is arranged in the means 2 for effecting an electroslag remelting process with a clearance between an internal surface 9 of this means 2 and a side wall 10 of the disc 6, said clearance being equal to at least the thickness of a scull crust 11 on the internal surface 9 of the means 2 for effecting an electroslag remelting process.

A method for realizing an electroslag remelting process by making use of the above-described device consists in the following.

Metal ingots are produced from the consumable electrode 4 by melting it in the slag bath under the effect of heat given up in the molten slag bath 3 by the passage of electric current therethrough.

As soon as this slag bath 3 is established and a metal pool 12 is set up by melting the consumable electrode 4, the disc 6 with an opening for the passage of the electrode 4 is lowered on the surface of the slag bath 3 so that it (the disc 6) will float without coming in contact with the metal pool 12.

It is achieved by manufacturing the disc 6 from a material whose specific density is lower than that of the slag, the thickness of the disc 6 being selected so that an ejection force acting on the disc 6 on the side of the molten slag bath 3 will hold it in the slag bath with the bottom part of the disc 6 not touching the metal pool 12.

The clearance between the side surface 10 of the disc 6 and the internal surface 9 of the means for effecting an electroslag remelting process, as well as that formed between the walls 7 of the opening in the disc 6 and the electrode 4 provide free motion of the disc 6 upwards as the ingot is being built up, said motion being accomplished due to the ejection force acting constantly on the disc 6 from the side of the molten slag bath 3.

During the electroslag process the protective shield made as a disc 6 floats on the surface of the slag bath 3 overlapping essentially all its surface, precluding thereby considerable thermal radiation losses and diminishing materially heat losses in the place of contact of the slag bath and the means 2 for effecting an electroslag remelting process.

Figure 2:
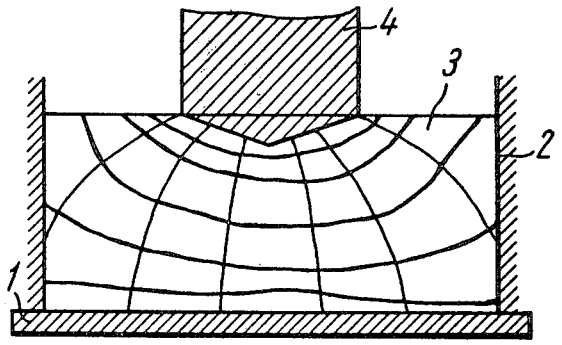
FIG. 2 is a schematic drawing illustrating the distribution of an electric field in a slag bath with an electrode that is not provided with a protective shield made as a disc.
Figure 3:
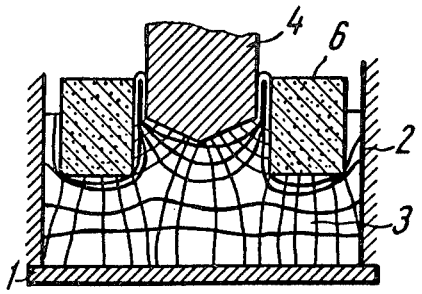
FIG. 3 is a schematic drawing showing the distribution of an electric field in a slag bath with an electrode provided with a protective shield made as a disc.

The arrangement on the surface of the slag bath 3 of the disc 6 in a material whose electrical conductivity is higher than that of the molten slag at a working temperature, e.g., in graphite, graphitic carbon or carbon, changes abruptly the pattern of current distribution in the slag bath, as is seen when comparing electric field distribution in a slag bath without using a disc (FIG. 2) and with such a disc (FIG.3).

In FIGS. 2 and 3 equipotential lines showing voltage distribution in a slag bath are indicated by thick lines and electric current lines by thin lines.

During a conventional electroslag remelting process most of electric current passes through the endface of the electrode 4, the most heated zone of the slag bath 3, in which the consumable electrode 4 melts off, being therefore set up in the zone of this endface of the electrode 4.

Figure 4:
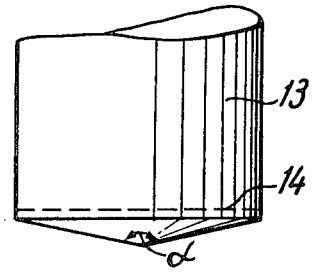
FIG. 4 shows a configuration of a consumable electrode end when the electroslag remelting process is carried out with an electrode not provided with a disc-shaped protective shield.
Figure 5:
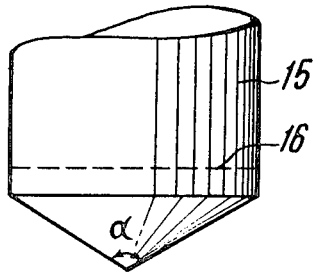
FIG. 5 depicts a configuration of a consumable electrode end when the electroslag remelting process is carried out by using an electrode fitted with a disc-shaped protective shield.

The presence in the slag bath of the disc 6 allows increasing the density of electric current around the melting consumable electrode 4. As a result, the amount of heat given up in the near-the-electrode zone increased, the electrode 4 melting off not only from its bottom endface portion but on the side of its external surface which happens to be immersed in the slag bath 3 much deeper than during conventional electroslag remelting. FIG. 4 shows a configuration of the fused end of an electrode 13 obtained during the electroslag remelting process carried out without using a disc-shaped protective shield. A dotted line 14 shows the depth of immersion of the electrode 13 into a slag bath. FIG. 5 shows a configuration of the fused end of an electrode 15 during the electroslag remelting process with a disc-shaped protective shield. A dotted line 16 indicates the depth of immersion of the electrode 15 into a slag bath.

The configuration of the fused end of the electrode 15 indicates that during an electroslag remelting process carried out with a disc-shaped protective shield the electrode 15 is dipped into a slag bath to a much greater depth and has a larger fused conical surface than the electrode 13 fused during the conventional electroslag remelting process. It proves that when using a protective shield a larger amount of heat is employed for melting an electrode.

Visual observation of an electroslag remelting process realized with the use of a disc 6 as a protective shield has shown that in the clearance between the wall 7 of the opening in the disc 6 and the external surface of the electrode 4 the slag rises above the top endface surface of the disc 6.

A higher density of electric current around the consumable electrode 4 and its immersion into the slag bath to a greater depth result in a higher melting rate of the electrode 4 at the same power consumption.

As shown by experiments, by using the proposed method of effecting an electroslag remelting process, envisaging the application of a protective shield made as the disc 6 immersed in the slag bath 5, the requisite rate of melting of the electrode 4 can be attained at a much lower power consumption.

As for the removal of nonmetallic inclusions diuring electroslag remelting processes, it is greatly affected by the value of a metal-slag reaction surface. A larger reaction surface and, hence, a higher rate of removal of nonmetallic inclusions from the metal in the course of electroslag remelting is observed on the following occasions:

(a) at an increase in the contact slag-metal surface of the electrode 4 in the course of melting of electrode metal and forming molten metal drops;

(b) an increase in reaction time of a metal droplet with the slag, as the droplet travels in the slag;

(c) at a decrease in the volume of molten metal contained in such a drop.

As compared with the conventional technology the electroslag remelting process realized by the proposed method by using the disc 6 as a protective shield affords the possibility of making optimum changes in all these three parameters.

With the disc 6 employed as a protective shield during electroslag remelting the melting of metal at the end of the electrode 4 occurs on a much greater conical surface, a feature enlarging the contact slag-metal surface of the electrode 4 during the drop-formation process.

The reaction time of a metal drop moving in the slag is also increased due to greater depth of a slag bath directly beneath the electrode 4 where the metal drop is moving. This is attributable to the ousting of slag by the disc 6 floating therein.

A reduction in angle $\alpha$ at the apex of the cone at the end of the consumable electrode 4, when using the protective shield made as a disc 6 during electroslag remelting, results in the diminution of the drops formed on the cone apex.

Thus, the above-described method of effecting an electroslag remelting process makes it possible to enhance the refining effect of slag on metal at the same slag consumption.

By changing the configuration of the disc 6 it is possible to redistribute thermal power, released in the slag bath, to suit technological requirements.

Figure 6:
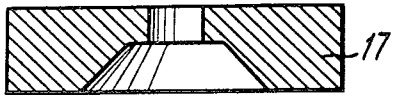
FIG. 6 shows a protective shield made as a disc progressively thickening towards its periphery.

If the protective shield is made as a disc 17 of increased or increasing thickness (FIG. 6) towards its periphery, the thermal power will be redistributed from the center to the periphery of the slag bath.

Figure 7:
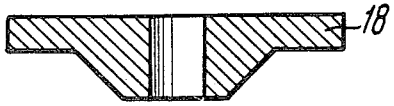
FIG. 7 shows a protective shield made as a disc progressively thickening towards its center.

If the protective shield is made as a disc 18 (FIG. 7) of increased or increasing thickness towards the center, the thermal power will be concentrated in the central zone of the slag bath.

A possibility of redistributing thermal power released in a slag bath is of particular importance during electroslag surfacing, welding and plating of metals.

The disc 6 (FIG. 1) floating on the surface of the slag bath 3 precludes to a great extent the access of oxygen from the ambient air to the surface of the slag bath 3. If the disc 6 in material featuring a higher deoxidizing ability than the elements contained in the metal and slag is lowered on the surface of the slag bath 3, it allows deoxidizing the slag during the electroslag remelting process and, hence, preserving easily-oxidizable elements in the metal.

Figure 8:
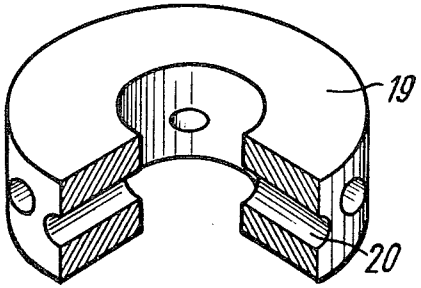
FIG. 8 shows a protective shield made as a disc with through radial conduits running from its center to the periphery.

Through radial conduits 20 running inside the disc 19 from its center to the periphery (FIG. 8) increase the contact surface of the disc 19 and slag ensuring more intense stiriring of the slag due to convection heat currents flowing through the conduits 20. It provides thereby the deoxidation of the slag and assists in equalizing the temperatures in the entire volume of the slag bath.

When using the above methods and devices it is expedient that the disc 6 preheated to a temperature of 500°-1200° C. be lowered on the surface of the slag bath 3 (FIG. 1). As outlined above, preliminary heating is needed to preclude the disturbance of stability of the processes and deoxidize the slag from the amount of introducing the disc 6 thereinto. The combination of carbon contained in the disc 6 with oxygen from ambient air and, hence, the oreation of a protective atmosphere takes place at a minimum temperature of 500° C. Therefore preheating to a temperature below 500° C. is ineffective. A preheating temperature of 1200° C. can be considered to be the most advisable. This is attributable to the fact that in this case no special heating sources are required, conventional heating means being quite sufficient. Moreover, as shown by measurements of the disc temperature during an electroslag remelting process, its average temperature approximates 1200° C.

Upon consuming the disc 6, another similar disc (not shown in the drawing) is lowered thereon. Said disc can be preliminary fitted on the electrode 4 and fixed in the zone of the top endface of the means 2 for effecting an electroslag remelting process. The number of such discs should be sufficiently great to suffice the entire remelting process.

Given hereinbelow are exemplary embodiments of the above-described method and device.

FIG. 9 shows diagrammatically a plant for the electroslag remelting of metals.

The plant comprises a column 21 along which moves a carriage 22 with an electrode holder 23 in which a consumable electrode 4 is fixed. The consumable electrode 4 is introduced into the means 2 for effecting an electroslag reme'ting process, a mold mounted on the baseplate 1 being used as said means 2. Both the consumable electrode 4 and baseplate 1 are connected to a current source 5.

The herein-proposed device functions and the above-described method is realized therein in the following manner.

Prior to the beginning of the process a requisite number of discs 6 is fitted on the consumable electrode 4 (from its bottom end) and fixed at the top mold end. If required, the disc 6 can be preheated (presented in FIG. 9 is only one disc 6).

Next molten slag is poured into the means 2 for effecting an electroslag remelting process and a slag bath 3 is established, the end of the consumable electrode 4 being fed into this bath. Then electric current is passed from the current source 5 through the consumable electrode 4, slag bath 3 and baseplate 1.

When setting up a metal pool 12 the disc 6 is lowered on the surface of the slag bath 3 and the electroslag remelting of the consumable electrode 4 continues.

Electrical conditions maintained during melting should be such that the rate of growth of a metal ingot 24 will approach the rate of solidification of the metal.

As the disc 6 is being consumed, a similar preheated disc (not shown in the drawing) is lowered thereon.

Before the completion of the remelting process the magnitude of remelting current is decreased, the process being carried out at a low current magnitude to preclude the occurence of shrinking macrodefects.

Upon detaching the current source 5 and lifting the electrode 4, the disc 6 can be withdrawn from the molten slag bath 3 and kept for further use.

FIG. 10 shows diagrammatically a plant for casting metal ingots by the electroslag remelting technique.

The plant comprises a column 21 along which moves a carriage 22 with an electrode holder 23 in which is fixed a hollow nonconsumable graphite electrode 25 provided with a hopper 26 in its top portion.

The hollow nonconsumable graphite electrode 25 is dipped into a means 2 for effecting an electrosslag remelting process, which is a mold mounted on a baseplate 1. The nonconsumable graphite electrode 25 and baseplate 1 are connected to a current source 5.

The plant for casting metal ingots by electroslag remelting is prepared for receiving molten metal in the following manner. The means 2 for effecting an electrical remelting process is set up on the baseplate 1, a requisite number of discs 6 is put on the nonconsumable electrode 25 and fixed at the top end of the means 2 for effecting an electroslag remelting process, whereupon molten slag is poured into the means 2 for effecting an electroslag remelting process to establish a molten slag bath 3. After that the nonconsumable graphite electrode 25 is dipped into the slag bath 3 and electric current is fed from the current source 5 and passed through the nonconsumable graphite electrode 25, slag bath 3 and baseplate 1, said current heating the slag bath 3. Following that the disc 6 is lowered on the slag bath 3 and after it has been heated a ladle 27 with molten metal 28 is placed above the receiving hopper 26. The molten metal 28 is poured through an opening 29 in the bottom part of the ladle 27. Electroslag heating after pouring ensures complete regulation of the forming shrink hole.

The present invention may also prove to be advantageous for effecting electroslag welding of metals. FIG. 11 shows diagrammatically the relative position of elements in electroslag welding with one electrode. A slag bath 3 is arranged between the edges of parts 30 to be welded. Dipped into the slag bath 3 is an electrode 4 which is a welding electrode that melts during welding. A protective shield made as a disc 6 having holes for the electrode 4 is fed along the electrode 4 on the slag bath so that it (the disc) floats on the surface of the slag bath 3 overlapping essentially the entire surface of the slag bath 3.

FIG. 12 presents the relative position of elements while effecting electroslag welding with a plurality of electrodes when joining together the edges of parts of large thickness. The slag bath 3 is held between the edges of the parts 30 being welded by means of slag-retaining devices 31. Dipped into the slag bath 3 are electrodes 4 on which a protective shield made as a disc 32 is put, according to the invention, so that the disc 32 floats on the surface of the slag bath 3 overlapping essentially all its surface area. In this case the disc 32 is fitted with several openings 33 for the passage of the electrodes 4 and thus the shape of the disc need not be round. As shown in FIG. 12, the disc is of rectangular shape in this case as a plurality of electrodes 4 all pass through the same disc.

The processes in welding with a single or a plurality of electrodes being similar, considered hereinbelow will be the process of welding parts with several electrodes, as shown in FIG. 12.

The above process consists essentially in the following.

In a space bounded by the edges of the parts 30 being welded and slag-retaining devices 31 is set up the molten slag bath 3 into which are dipped metal rods - consumable electrodes 4. The disc 32 fitted beforehand on the consumable electrode 4 is lowered from above on the surface of the slag bath 3. Electric current is passed through the consumable electrodes 4, slag bath 3 and parts 30 being welded.

Under the effect of electric current the slag bath 3 is heated above the melting point of the metal of the parts 30 being welded and that of the consumable electrodes 4. The slag bath 3 melts the electrodes 4 dipped therein and fuses the edges of the parts 30 to be welded.

Upon mixing with the metal of the parts being welded the molten electrode metal sets up a metal pool 12. As the consumable electrodes 4 fed continuously into the slag bath 3 are being melted, both the slag bath 3 and metal pool 12 climb upwards, the disc 32 floating freely on the surface of the slag bath 3 also rising under the effect of an ejection force and the bottom metal layers being solidified forming a weld 34 interconnecting the edges of the parts 30 being welded. Usually the surface of the weld 34 is molded by the slag-retaining devices 31 which are sliding shoes moving upwards and cooled with water supplied via pipes 35.

Electroslag welding with the use of a disc floating on the surface of a slag bath not only offers a saving in electric power due to lower heat losses and heat concentration in the electrode melting zone but it affords the possibility of deoxidizing slag and preserving thereby easily-oxidizable elements in deposited metal. It improves also the refining effect of the slag on the metal and affects the penetration of the edges of the parts 30 being welded.

FIG. 13 illustrates one more application of the above method - a slag-melting-and-heating plant.

Lately the electroslag refining of metals is effected in the majority of countries by using the so-called molten slag starting, i.e., by pouring molten preheated slag. The process of preliminary melting and heating involves power consumption, and the herein-proposed method of effecting of the electroslag remelting process being therefore advisable to be employed provide a saving in electric power.

Usually slag is melted in a means 2 for effecting an electroslag remelting process, which is a graphite crucible lined with refractory material 36 from the outside. A slag-melting plant comprises a column 21 along which moves a carriage 22 with an electrode holder 23 in which a nonconsumable electrode 37 is fixed. The crucible in refractory material that is employed as a means for effecting an electroslag remelting process and the nonconsumable electrode 37 are connected to a current source 5.

The herein-proposed method is realized in the following manner.

Prior to the beginning of the process a disc 6 is put on the electrode 37 and secured thereon. Solid slag is poured on the bottom of the means 2 for effecting an electroslag remelting process and an electric arc is striken by touching the bottom of the means 2 with the end of the electrode 37, said arc melting the slag. As soon as a molten slag bath 3 is set up the arc process is converted into an electroslag one. Solid slag is added in small lots to provide a sufficiently deep slag bath 3 so that the disc 6 will float therein without coming in contact with the bottom of the means 2. Following that the disc 6 is lowered on the surface of the slag bath 3 and the subsequent lots of the solid slag are melted and heated.

The next lots of the slag are poured directly on the disc 6. The slag falls through clearances between the internal walls of the disc 6 and the surface of the electrode 4 and between the walls of the means 2 for effecting an electroslag remelting process and the side surface of the disc 6, and gets into the slag bath 3 where it melts adding to the volume of the slag bath 3. In this way the process is carried out until the required amount of molten slag is obtained.

Considered hereinbelow are the results obtained by the application of the above method for the electroslag remelting of metal electrodes.

An enhancement in the efficiency of the electroslag remelting of consumable electrodes was investigated by using consumable electrodes in steel, grade (A), 50 mm in diameter, (Table 1) remelted in a water-cooled mold, 150 mm in diameter. A 2000 A melting current and 45 V voltage were used.

In the first case the remelting process was carried out according to a conventional flow sheet and in the second one by using the proposed method.

In the first case the process was as efficient as to give 27 kg/hr, while in the second case it gave 58 kg/hr.

Numerous experiments have proved that the efficiency of the electroslag remelting process realized according to a new method increased almost two and even more times.

The effect of introducing the disc 6 (FIG. 1) freely floating in the slag bath 3 was investigated by lowering a graphitic carbon disc into the slag, grade (B) (Table 1) when remelting an electrode in grade (A) steel of similar dimensions and under similar melting conditions as those specified above when examining an enhancement of the process efficiency. Moreover, similar experiments were carried out during the electroslag remelting of a consumable electrode, 40 mm in diameter, in steel, grade (C) (Table 1) into ingots of the same size and in the same mold as those employed for grade (A) steel. For purpose of comparison all the experiments were conducted both without the disc 6 and by introducing it into the slag bath.

Chemical composition analysis of steel, grade (A), of the consumable electrodes (Table 1) so as ingots of steel, grades A and C, produced by the electroslag remelting technique (Table II) carried out according to a conventional flow sheet and by lowering a graphitic carbon disc on the surface of a slag bath, shows that a graphitic carbon disc lowered on the surface of a slag bath diminishes oxidation of easily-oxidizable elements by decreasing the access of oxygen from ambient air to the surface of the slag bath and because the material of the disc 6 features a higher deoxidizing ability than the elements incorporated in the composition of the deposited metal and slag. Moreover, at a high temperature attained during the electroslag remelting of metals carbon combines with oxygen from ambient air forming compounds of the CO- and $CO_2$-type which in turn create a protective atmosphere.

In practice it allowed avoiding substantial oxidation of silicium in grade (A) steel and titanium in grade (C) steel.

To evaluate the configuration of fused electrodes one and the same electrode was melted by a conventional process and by using a disc, into the same mold accommodating the same amount of slag (B) and under the same melting conditions.

In both cases the electrodes, upon de-energizing, were quickly withdrawn from the slag bath.

The configuration of the fused ends of the electrodes 13 and 15 (FIGS. 4 and 5) is a convincing proof indicating that the electrode 15 (FIG. 5) melted with the disc was introduced to a greater depth into the slag bath and had a larger tapered surface.

A reduction in the size of metal drops formed on the apex of this cone is proved by observing the process with the aid of an oscillograph connected to the terminals of an ammeter for measuring remelting current.

As is known, the oscillograms are characterized by the smooth rise of the current corresponding to the drop formation and followed by a jump-like decrease in the current amplitude when the drop breaks off from the consumable electrode. As shown by the oscillograms, the rate of formation of metal drops and of their breaking off increases several times upon lowering the disc as compared with a classical electroslag remelting flowsheet, this being indicative of a higher rate of electroslag remelting.

Table 1

Chemical composition of metal after electroslag remelting without and with disc

| | Chemical composition, % | | | | | | | | | | |
|---|---|---|---|---|---|---|---|---|---|---|---|
| Substance | Fe | C | Mn | Si | Cr | Ni | Ti | S | P | $CaF_2$ | $Al_2O_3$ |
| Steel A | base | 0.24 | 0.55 | 0.27 | — | — | — | 0.019 | 0.018 | — | — |
| Slag B | — | — | — | — | — | — | — | — | — | 70 | 30 |
| Steel C | base | 0.07 | 1.42 | 0.48 | 17.42 | 10.26 | 0.51 | 0.002 | 0.014 | — | — |

Table 2

| Steel grade | Electroslag remelting conditions | Chemical composition, % | | | | | | | | |
|---|---|---|---|---|---|---|---|---|---|---|
| | | Fe | C | Mn | Si | Cr | Ni | Ti | S | P |
| $A^I$ | without graphitic carbon disc | base | 0.23 | 0.50 | 0.18 | — | — | — | 0.003 | 0.018 |
| | with graphitic carbon disc | base | 0.24 | 0.47 | 0.26 | — | — | — | 0.003 | 0.0015 |
| $C^I$ | without graphitic carbon disc | base | 0.08 | 1.38 | 0.49 | 17.42 | 10.26 | 0.29 | 0.002 | 0.018 |
| | with graphitic carbon disc | base | 0.08 | 1.38 | 0.51 | 17.35 | 10.36 | 0.43 | 0.002 | 0.016 |

What we claim is:

1. A device for effecting an electroslag remelting process, comprising a baseplate on which is mounted a means for effecting an electroslag remelting process; a molten slag bath set up in said means for effecting an electroslag remelting process; an electrode having one of its ends dipped into said slag bath, its other end being connected to a current source; a protective shield positioned concentrically around the end of said electrode being dipped into said slag bath; said shield being made as a disc of an electrically conductive material which has a higher electrical conductivity than that of the molten slag and whose specific density is lower than that of the slag of said slag bath, said disc overlapping essentially the entire surface area of said slag bath and being arranged in said means for effecting an electroslag remelting process with a clearance between an internal surface of said means for effecting an electroslag remelting process and a side wall of said disc that amounts to at least the thickness of a scull crust on the internal surface of said means for effecting an electroslag remelting process, and with a clearance between the wall of the opening said disc and said electrode that is equal to at least the thickness of a scull crust of said electrode, and said protective shield being made as a disc with through radial conduits running inside said disc from its center to the periphery thereof.

2. A device for effecting an electroslag remelting process of claim 1, wherein said protective shield is made as a disc, the thickness of which increases towards its periphery.

3. A device for effecting an electroslag remelting process of claim 1, wherein said protective shield is made as a disc, the thickness of which increases towards its center.

* * * * *